US009494396B2

(12) United States Patent
Peter et al.

(10) Patent No.: US 9,494,396 B2
(45) Date of Patent: Nov. 15, 2016

(54) NON-LETHAL PROJECTILE

(71) Applicants: Kurt Peter, Pfaffstätten (AT); Heribert Seidler, Wien (AT)

(72) Inventors: Kurt Peter, Pfaffstätten (AT); Heribert Seidler, Wien (AT)

( * ) Notice: Subject to any disclaimer, the term of this patent is extended or adjusted under 35 U.S.C. 154(b) by 0 days.

(21) Appl. No.: 14/370,105

(22) PCT Filed: May 7, 2013

(86) PCT No.: PCT/AT2013/000084

§ 371 (c)(1),
(2) Date: Jul. 1, 2014

(87) PCT Pub. No.: WO2013/177603

PCT Pub. Date: Dec. 5, 2013

(65) Prior Publication Data

US 2015/0260494 A1 Sep. 17, 2015

(30) Foreign Application Priority Data

May 31, 2012 (AT) ..... A 633/2012

(51) Int. Cl.

| | |
|---|---|
| ***F42B 12/02*** | (2006.01) |
| ***F42B 8/12*** | (2006.01) |
| ***F42B 12/36*** | (2006.01) |
| ***F42B 12/74*** | (2006.01) |
| ***F42B 30/06*** | (2006.01) |

(Continued)

(52) U.S. Cl.

CPC ..... *F42B 12/02* (2013.01); *F41A 21/26* (2013.01); *F41A 21/32* (2013.01); *F41C 27/06* (2013.01); *F42B 8/12* (2013.01); *F42B 12/36* (2013.01); *F42B 12/745* (2013.01); *F42B 30/06* (2013.01)

(58) Field of Classification Search

CPC ..... F42B 30/02; F42B 10/48; F42B 30/00; F42B 12/367; F42B 12/02; F42B 7/08; F42B 7/04; F42B 7/046; F42B 30/04; F42B 30/06; F41A 17/44

USPC ..... 102/502

See application file for complete search history.

(56) References Cited

U.S. PATENT DOCUMENTS 2,421,752 A * 6/1947 Jones ..... F42B 12/68 102/222
2,853,008 A * 9/1958 Bowles ..... F42B 30/06 102/485

(Continued)

FOREIGN PATENT DOCUMENTS

DE 7616574 U1 12/1976
DE 102006042782 A1 * 3/2008 ..... F41A 21/32

(Continued)

*Primary Examiner* — Troy Chambers
*Assistant Examiner* — Bridget Cochran
(74) *Attorney, Agent, or Firm* — Bachman & LaPointe, PC

(57) ABSTRACT

A non-lethal projectile for firing by a firearm by discharging a conventional bullet (5), the non-lethal projectile comprising a body (7), the interior of which contains a bullet trap (15, 22) for the bullet (5) which uses up a considerable part of the kinetic energy of the bullet by friction and deformation and converts a fraction of the kinetic energy into kinetic energy of the projectile. For that purpose the bullet trap consists of a plug (22) and a catching piece (15), wherein the rear part of the plug (22) is a peg (23) that can be inserted into the mouth of the barrel (4). The catching piece (15) is a hollow cylinder, which has a blind bore (17) closed at the front face of the hollow cylinder, the hollow cylinder being pressed for a part of the length thereof into a blind bore (10) of the body (7) that is closed at the front.

6 Claims, 3 Drawing Sheets

(51) Int. Cl.

| | |
|---|---|
| ***F41A 21/26*** | (2006.01) |
| ***F41A 21/32*** | (2006.01) |
| ***F41C 27/06*** | (2006.01) |

(56) References Cited

U.S. PATENT DOCUMENTS

| | | | | | |
|---|---|---|---|---|---|
| 3,243,909 | A * | 4/1966 | Kotikov | F41C 27/06 | 102/483 |
| 3,491,693 | A * | 1/1970 | Streckfuss | F42B 30/06 | 102/485 |
| 3,726,036 | A * | 4/1973 | Jennings | F42B 30/06 | 102/485 |
| 3,733,727 | A * | 5/1973 | Jones | F41C 27/06 | 102/444 |
| 3,934,513 | A * | 1/1976 | Gabriels | F42B 30/06 | 102/485 |
| 4,823,702 | A * | 4/1989 | Woolsey | F42B 12/34 | 102/460 |
| 5,375,529 | A * | 12/1994 | Knight, Jr. | F42B 8/16 | 102/502 |
| 5,440,795 | A * | 8/1995 | Chon | B02C 13/28 | 29/401.1 |
| 5,561,263 | A * | 10/1996 | Baillod | F42B 12/66 | 102/483 |
| 5,574,245 | A * | 11/1996 | Buc | F42B 30/06 | 102/485 |
| 7,526,999 | B1 * | 5/2009 | Timan | F41C 27/06 | 102/502 |
| 9,038,540 | B2 * | 5/2015 | Brosky | F41F 1/06 | 102/485 |
| 2005/0284325 | A1 * | 12/2005 | Saxby | F42B 12/40 | 102/502 |
| 2014/0109790 | A1 * | 4/2014 | Dannawi | F42B 8/12 | 102/502 |

FOREIGN PATENT DOCUMENTS

| | | | |
|---|---|---|---|
| GB | 1213016 | A | 11/1970 |
| GB | 2223833 | A | 4/1990 |
| WO | 0111305 | A2 | 2/2001 |

* cited by examiner

NON-LETHAL PROJECTILE

BACKGROUND OF THE INVENTION

The invention relates to a non lethal (or less lethal) projectile launchable by means of a fire arm, the projectile being fitted to the barrel of the fire arm—in particular a pistol—and being launched by firing a conventional bullet, the projectile comprising a body which contains a bullet trap. Such projectiles are used for law enforcement against persons. They must not inflict serious injuries to persons, but prevent them from committing criminal acts. As situations requiring the use of such projectiles can occur unexpectedly, they must be launchable by firing conventional bullets. This also requires firing a conventional bullet immediately after launching the projectile.

A non lethal projectile of this kind is proposed by the publication WO 01/11305. It is a hollow cylinder plugged outside around the barrel with a fragile impact head in front, which may contain a liquid. The hollow cylinder is closed in front by a bullet trap which is described as consisting of a material that is inpenetrable by the bullet. Further the description states that the initial velocity of the projectile is 10 percent lower than the muzzle velocity of the bullet. This confirms what the inpenetrable bullet trap suggests: Almost the whole kinetic energy of the bullet is transferred to the projectile which thus is far too fast to be harmless. This cannot be mitigated by the fragile impact head, let alone the bullet-like shape of the projectile and the stabilization wings. This projectile therefore is utterly unsuitable for the cited purpose.

With rifle grenades launchable by means of a bullet it is necessary to transfer as much of the kinetic energy of the bullet as possible to the rifle grenade in order so attain a sufficient operating range. This not least because the mass of the rifle grenade is a multiple of the mass of the bullet. Such a rifle grenade is known from the publication GB 22 23 833 A. It comprises a bullet trap that conveys essentially the whole kinetic energy of the bullet to the projectile in an optimized course/time curve.

With a projectile fit for the purpose explained at the beginning, it is important that its nature (shape and mass) does not inflict serious injury and it is of foremost importance that its impact velocity is low, even with a target at low distance. This is the problem which the invention sets out to solve.

SUMMARY OF THE INVENTION

According to the invention, part of the projectile is insertable in the muzzle of the barrel and the bullet trap consumes a considerable part of the kinetic energy of the bullet (exactly speaking: translates it into deformation energy and friction heat) and transfers only a fraction thereof in kinetic energy of the projectile. This has the effect that a comparatively lightweight projectile can be launched with an initial velocity necessary for a sufficient range (distance of the target) without being destroyed by the bullet. Mounting the projectile by inserting part of it into the muzzle has the advantage over plugging it outside around the barrel, that the projectile can be launched from different fire arms.

To this end, the bullet trap for consuming or translating a major part of the kinetic energy comprises at least one plastically deformable element longitudinally shiftable in the body over a distance against frictional forces. By the combined effects of a sufficient frictional travelling length and the inner friction by plastic deformation of the plug a sufficient amount of kinetic energy is consumed.

In an advantageous embodiment the bullet trap comprises a plug and a catching piece, the rear part of the plug is a peg insertable into the muzzle of the barrel and the front part of the plug is a cylinder cooperating with the catching piece. The plug serves two purposes: first, it constitutes a friction surface with the catching piece, which surface can be suitably dimensioned and shaped for consumption of energy. Second, it is plugged into the muzzle of the barrel and in this way holds the projectile.

In a particular embodiment, the front part of the plug is a hollow cylinder whose inner diameter is equal or superior to the outer diameter of the peg, the hollow cylinder resting against a second circular ring-shaped shoulder of the catching piece and, because of its equal or superior inner diameter constitutes a breaking zone at its transition to the peg. Shearing off the hollow cylinder at the breaking zone consumes further kinetic energy of the bullet.

In a preferred embodiment of the invention, the catching piece is a hollow cylinder with a concentric blind hole which is closed in front and open behind. The catching piece is pressed into a blind bore likewise closed a its front end along part of its length, so that the catching piece is shiftable along the remaining part of the length of the blind bore by application of force. After being sheared off, the peg is shiftable into the blind hole of the catching piece against friction. The diameter of the blind hole being equal or inferior to the diameter of the peg, two friction surfaces of considerabe length are provided: the first between the peg and the catching piece and the second between the catching piece and the body of the projectile. This doubles the length of the braking path with regard to the length of the projectile, thus provides a very long shifting path against friction.

In a development of the invention, the plug is made from a ductile material (preferably a thermoplast) and the rear end of the peg has a centric recess from whence the peg is deformable under force. The deformation of the plug consumes further kinetic energy. The bullet hitting the centric recess penetrates the peg entirely and deforms it into a tube-like shape. Due to the large deformed volume of the peg, a particularly high amount of kinetic energy is consumed.

In a further development of the invention the longitudinal dimensions of catching piece, plug, blind hole and blind bore are chosen in a way to locate the gravity center of the projectile in free flight approximately in its geometric centre and the collar of the catching piece does not protrude from the contour of the body. With a spherical contour of the projectile this would be the center of the sphere.

The spherical contour resolves a secondary problem: As transfer of the spin of the bullet to the projectile only occurs to a small extent, if at all, the projectile is not stabilized by gyroscopic effect. For in-flight stabilization by the winglets (as in WO 01/11305) the travelling speed is insufficient. An oblong projectile therefore would tumble in flight and could ricochet. Due to the spherical contour of the projectile, particularly with the gravity center in the geometric center, the projectile in flight may rotate in any manner and which region of the contour will hit the target is indefinite and immaterial. Thanks to the body of the projectile being enveloped by a soft coat consisting of a foamy or other soft material, it does not need to be spherical (reducing its weight) and the soft coat assures that the target person suffers no lethal injury.

In order to reduce the weight and to improve the bond between the body of the projectile and the spherical coat, the body—for instance made of a plastic material—can have ribs and the soft coat is formed by injecting a foamed plastic material. This facilitates applying the coat. The body made of plastic material has the further advantage that it can give way when the catching piece is expanded by the penetrating bullet.

Finally, two further measures within the framework of the invention contribute to the safety of the target persons: If the diameter of the spherical contour is superior to 4, prefereably 5, cm, the projectile can not enter the orbital cavity of the eye, thus obviating severe eye injury. If further it is made sure that the hind edge of the catching piece does not protrude from the contour of the projectile, it can not cause severe injuries if the projectile hits the target person with its rear zone.

BRIEF DESCRIPTION OF THE DRAWINGS

In the following, the invention will be described and commented along the following drawings.

DETAILED DESCRIPTION

Figure 1:
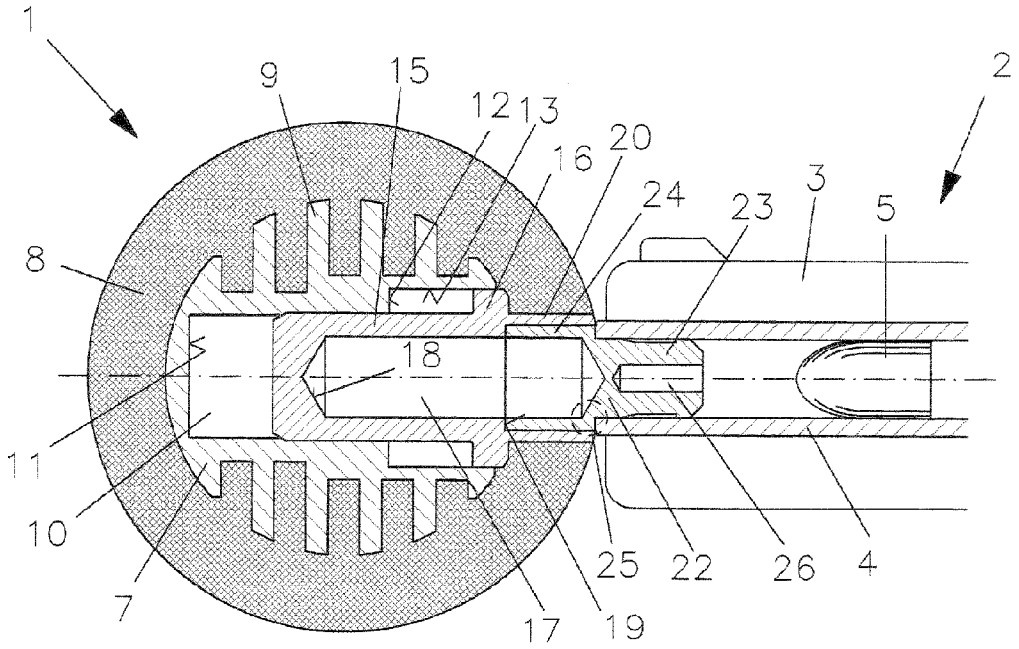
FIG. 1 is a longitudinal section through a preferred embodiment of the invention in a first phase.

In FIG. 1, the projectile according to the invention has the reference number 1 and a pistol of any known kind has the reference number 2. Of this pistol 2, only the front part of a slide 3 and a barrel 4 is shown. A bullet 5 is already under way. Thus, FIG. 1 also shows the first phase of firing the projectile.

The projectile 1 according to the invention generally consists of a body 7 and a coat 8. The body 7 is made of a light metal or a robust plastic material (for example a thermoplast) and has circumferential ribs 9. In order to create a coat, it is embedded in a foamy material. The body 7 has a central blind bore 10 in longitudinal direction, with a bottom 11 at its front end. As can be seen, the blind bore 10 extends over most of the length of the body 7. The open rear end of the blind bore 10 has a flaring 13 ending in a first shoulder 12.

The bullet trap located inside the body 7 comprises a catching piece 15 and a plug 22. The catching piece 15 is a circular cylinder with a blind hole 17, its front end forming a bottom 18. The outer diameter of the cylinder is greater than the inner diameter of the blind bore 10, so as to be shiftable in the longitudinal direction only by prevailing over considerable frictional resistance. The rear rim of the catching piece 15 has a flange 16 and a collar 20 directed rearwards. The collar 20 has the same or a somehow larger inner diameter as the blind hole 17 and forms a second inner shoulder 19 in front.

The plug 22 is a hollow cylinder passing over in a peg 23 at its rear end. The transition 25 is a circumferential breaking zone 25. The peg 23 is inserted in the barrel 4 and in this way holds the projectile 1 ready for firing. The rear end of the peg 23 has a centered recess or bore 26, with the consequences described below if hit by the bullet 5. The plug is made of a ductile material, metallic or, preferably, a tenacious and hard plastic.

In the following, the effect of the invention will be described along all three Figures:

In FIG. 1, the pistol has already been fired, the bullet 5 is moving towards the plug 22 in the barrel 4. It will shortly push the peg 23 out of the barrel (if this has not already been done by the air column in front of the bullet) and push the peg 23 into the blind bore 17 with force. As the hollow cylinder 24 of the plug 22 rests against the second shoulder 19, the peg 23 will be separated off from the hollow cylinder 24 in the circumferential breaking zone 25. The inner diameter of the hollow cylinder being equal to or greater than the diameter of the peg 23, separation will be by shearing. Already in this phase kinetic energy of the bullet 4 is consumed.

Figure 2:
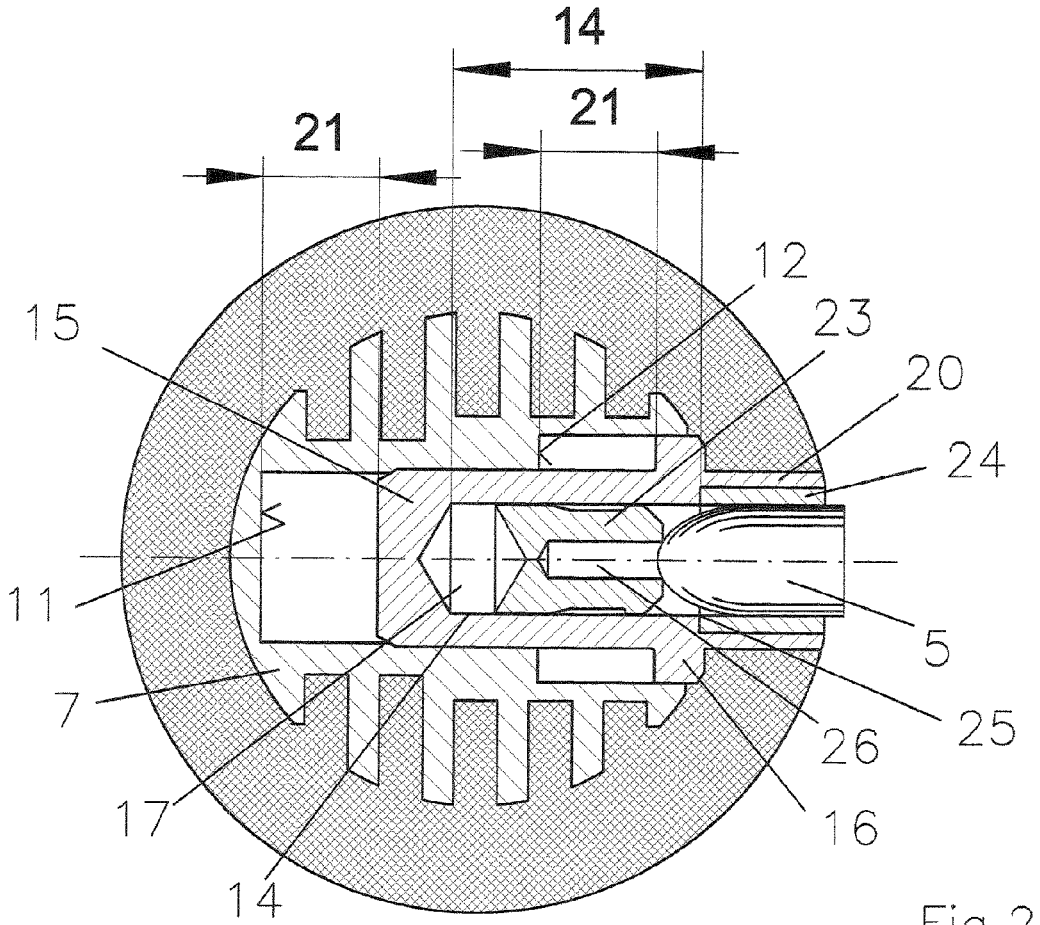
FIG. 2 shows the same in a second phase.

In FIG. 2, the so separated peg 23 is pushed into the blind bore 17, whereby during the whole length 14 friction force must be overcome. It can be seen that the hollow cylinder 24 remained in the collar 20 of the catching piece 15. When the peg 23 has reached the bottom 18 of the blind holoe 17, the kinetic energy of the bullet has the effect that also catching piece 15 is shifted forward in the blind bore 10 of the body 7 until it hits the bottom 11 of the blind bore 10. The outer diameter of the catching piece 15 being somehow greater than the inner diameter of the blind bore 10, considerable frictional forces must be overcome over the whole travelling length 21.

The travelling length 21 in FIG. 2 is the distance between the front end of the catching piece 15 and the bottom 11 of the blind bore 10. The same distance 21 is also between the flange 16 of the catching piece and the first shoulder 12 of the body 7. As soon as the catching piece 15 has covered the travelling length 21, the bullet 5 starts penetrating the central recess 26 of peg 23. To achieve this is the main purpose of recess 26.

Figure 3:
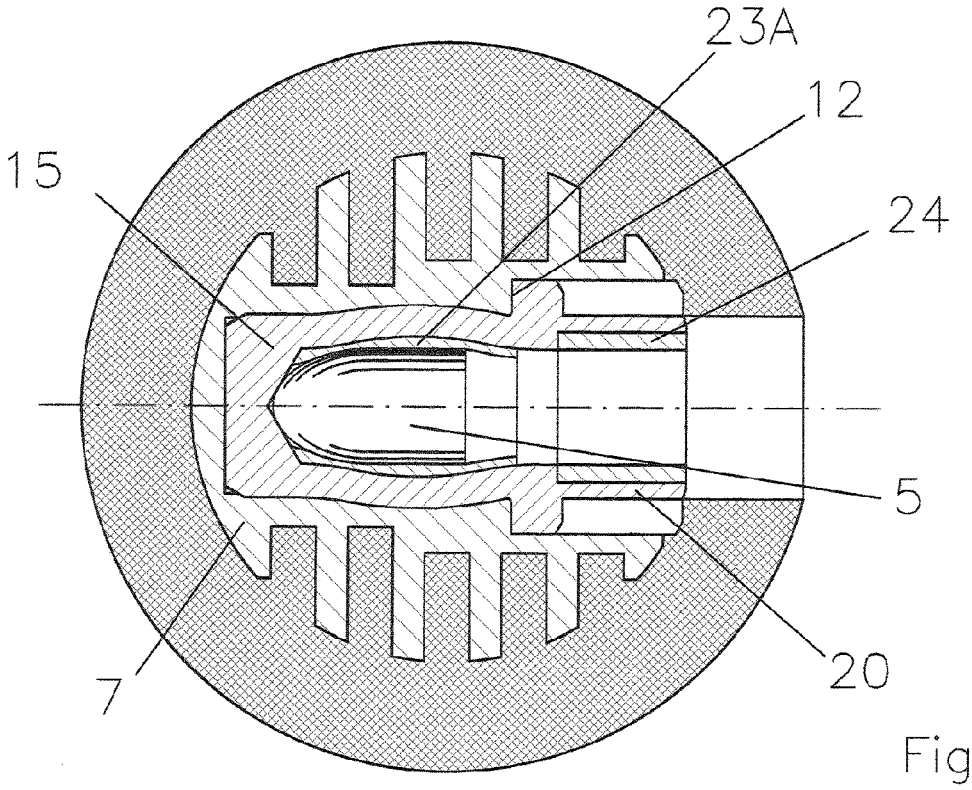
FIG. 3 shows the same in a second phase.

In FIG. 3, the bullet has already penetrated the peg 23 all along, transforming the peg 23 in a tube-like structure 23*, thereby consuming a considerable amount of energy. It can be seen that also the circumferential wall of the catching piece 15 has been bulged outward by the radially outward pressure. This does not damage the body 7 thanks to appropriate selection of the material it is made of. In this position, the gravity center of the projectile 1 with the bullet trap and the bullet in this final position coincides approximately with its geometric center. It can also be seen in FIG. 3 that in the final position of the catching piece 15, its collar 20 remains within the contour of the body 7. Therefore hitting the target person with the rear zone does not cause severe injuries.

Altogether, in this manner energy is consumed in five consecutive steps: in the circumferential breaking zone 25, by friction in the blind hole 17, again by friction in the blind bore 10, by deforming the wall of the catching piece 15 and by deformation of the peg 23. Thereby a major part of the kinetic energy even of a high-energy bullet can be converted in friction heat and deformation work, with a projectile of low mass (this results in the desirable low impact energy). It is within the scope of the invention to reduce the bullet trap by omitting the second friction, between the catching piece 15 and the body 7, when a smaller and slower bullet is used.

The invention claimed is:

1. Non-lethal projectile launchable by a fire arm, wherein the projectile is fitted in a barrel of the fire arm and is launched by firing a conventional bullet, the projectile comprising a body, the body contains a hollow space receiving at least a part of a bullet trap adapted to receive a fired bullet, wherein part of the projectile is insertable in a muzzle of the barrel and wherein the bullet trap consumes a considerable part of kinetic energy of the bullet and converts only a fraction thereof to kinetic enerdy of the projectile, wherein, in order to consume a considerable part of the kinetic energy of the bullet, the bullet trap comprises at least one plastically deformable element longitudinally shiftable in the body over a predetermined distance of the hollow space against frictional forces, and wherein the bullet trap comprises a plug and a catching piece, a rear part of the plug being a peg insertable into the muzzle of the barrel and a front part of the plug is a cylinder cooperating with the catching piece located in the hollow space, wherein the front part of the plug is a hollow cylinder whose inner diameter is equal or greater than an outer diameter of the peg, the hollow cylinder resting against a second circular ring-shaped shoulder of the catching piece and, because of its inner diameter constitutes a breaking zone at its transition to the peg.

2. Projectile according to claim 1, wherein the catching piece is a hollow cylinder having a blind hole closed at a front end, which fits into the hollow space which comprises a blind bore likewise closed at its front end along part of its length, so that the catching piece is shiftable along a remaining part of a length of the blind bore by application of force, the plug being shiftable into the blind hole of the catching piece against frictional forces.

3. Projectile according to claim 2, wherein the plug is made of a ductile material and the rear end of the peg has a centric recess from whence the peg is deformable under force.

4. Projectile according to claim 3, wherein the diameter of the blind hole is equal to or smaller than the diameter of the bullet, so that the latter deforms the peg, starting at its centric recess, into a tube-shaped body after the peg has hit a bottom of the catching piece).

5. Projectile according to claim 4, wherein the longitudinal dimensions of catching piece, plug, blind hole and blind bore are chosen in a way to locate the gravity center of the projectile in free flight is approximately in a geometric centre of the projectile and wherein a collar of the catching piece does not protrude from a contour of the body.

6. Projectile according to claim 1, wherein a diameter of a spherical contour of the projectile is greater than 4 cm.

* * * * *